United States Patent [19]

Schweitzer

[11] Patent Number: 4,462,064

[45] Date of Patent: Jul. 24, 1984

[54] COMPACT BATTERY-POWERED HEADLAMP

[76] Inventor: Robert B. Schweitzer, 1501 Palm Ave., Richmond, Calif. 94805

[21] Appl. No.: 419,590

[22] Filed: Sep. 17, 1982

Related U.S. Application Data

[63] Continuation of Ser. No. 211,752, Dec. 1, 1980, abandoned.

[51] Int. Cl.[3] ..... F21L 15/14

[52] U.S. Cl. ..... 362/105; 362/190; 362/191; 362/200; 362/202; 362/382

[58] Field of Search ..... 362/105, 190, 191, 200, 362/202, 382

[56] References Cited

U.S. PATENT DOCUMENTS 2,176,789 10/1939 Capitani .
2,234,995 3/1941 Waechter .
2,263,577 11/1941 Griner .
2,531,585 11/1950 Pope .
3,249,271 5/1966 Allbritton .
3,769,663 11/1973 Perl ..... 362/191
3,906,216 9/1975 Eriksson .
3,912,919 10/1975 Eriksson .
3,947,676 3/1976 Battilana et al. .
4,360,930 11/1982 Blanchard ..... 362/105

*Primary Examiner*—Stephen J. Lechert, Jr.
*Attorney, Agent, or Firm*—Manfred M. Warren; Robert B. Chickering; Glen R. Grunewald

[57] ABSTRACT

A headlamp assembly 10 including an elastic headband 16 and a tubular shaped clip 14 adhesively bonded to the elastic headband. A commonly available flashlight 12 can be inserted into a holster-like clip for use as a headlamp, or alternatively, it can be withdrawn from the clip for use as a flashlight. When used as a headlamp, the clip positions the light source of the flashlight behind the user's eye 30 with its light beam 34 angled toward the line of sight 36 of the user. The user may direct the light beam by rotating the headband to the appropriate position. Grit particles within the tubular section 22 of the clip act to grasp and retain the flashlight.

1 Claim, 7 Drawing Figures

COMPACT BATTERY-POWERED HEADLAMP

RELATED APPLICATION

This application is a continuation of application Ser. No. 211,752, filed Dec. 1, 1980 now abandoned and entitled "A Compact Battery-Powered Headlamp."

BACKGROUND OF THE INVENTION

The present invention relates generally to flashlight holders and relates more specifically to an improved headlamp assembly incorporating a detachable battery powered flashlight.

Headlamps are useful in situations where temporary illumination is required and both hands must be free. Situations also arise where illumination is required in locations that are inaccessible to headlamps, in which case flashlights must be used. Thus, a headlamp utilizing a detachable flashlight as its light source could advantageously be used in both of the above described situations.

Many designs for headlamps exist in the prior art yet none have been commercially successful for various reasons. Several prior art headlamps had light sources that were custom designed as headlamps and were permanently mounted on a headband. Since the light sources were an integral part of the headlamp assemblies, these headlamps were difficult to use as flashlights. See, for example, U.S. Pat. Nos. 2,176,789, issued Oct. 17, 1939 to Capitani; 2,234,995, issued Mar. 18, 1941 to Waechter; 3,906,216 issued Sept. 16, 1975 to Eriksson; 3,912,919 issued Oct. 14, 1975 to Eriksson; and 3,947,676 issued Mar. 30, 1976 to Battilana.

Several other prior art headlamps utilized flashlights as light sources. U.S. Pat. No. 2,263,577 issued Nov. 25, 1941 to Griner discloses an elastic headband for mounting a commonly available flashlight as a headlamp. As above, this headlamp had to be totally removed from the users head in order to use it as a flashlight. A combination flashlight and eyepiece for jewelers is disclosed in U.S. Pat. No. 2,531,585 issued Nov. 28, 1950 to Pope. Although detachable, the flashlight in the above disclosed invention was not suitable for general area illumination. U.S. Pat. No. 3,249,271, issued May 3, 1966 to Allbritton also discloses a detachable flashlight. In both of the two last mentioned headlamps, the directions of the light beams of the flashlight were not adjustable thereby limiting their usefulness. Another problem with both the Griner and Allbritton headlamps was that the flashlights would shine in the users eyes.

In summary, the prior art discloses headlamps having detachably mounted flashlights as light sources and headlamps having elastic headbands, although headlamps having both are not disclosed.

SUMMARY OF THE INVENTION

A. Objects of the Invention

Accordingly, it is an object of the present invention to provide an improved headlamp assembly having a detachably mounted flashlight for illumination.

It is another object of the present invention to provide an improved headlamp assembly using a commonly available battery powered flashlight as a light source.

Another object of the present invention is to provide an improved headlamp assembly with an elastic headband for user comfort.

A further object of the present invention is to provide an improved headlamp assembly using a flashlight positioned so that its light beam does not shine in the users eyes.

The headlamp assembly of the present invention has other objects and features which will be apparent from and are set forth in more detail in the accompanying drawing and the following description of the preferred embodiment.

B. Brief Summary of the Invention

A headlamp assembly includes an elastic headband and a tubular shaped clip adhesively bonded to the elastic headband. A commonly available flashlight can be inserted into the holster-like clip for use as a headlamp, or alternatively, it can be withdrawn from the clip for use as a flashlight. When used as a headlamp, the clip positions the flashlight behind the users eye with its light beam angled toward the line of sight of the user. The user may direct the light beam by rotating the headband to the appropriate position. Grit particles within the tubular section of the clip act to grasp and retain the flashlight.

DESCRIPTION OF THE PREFERRED EMBODIMENTS

Figure 1:
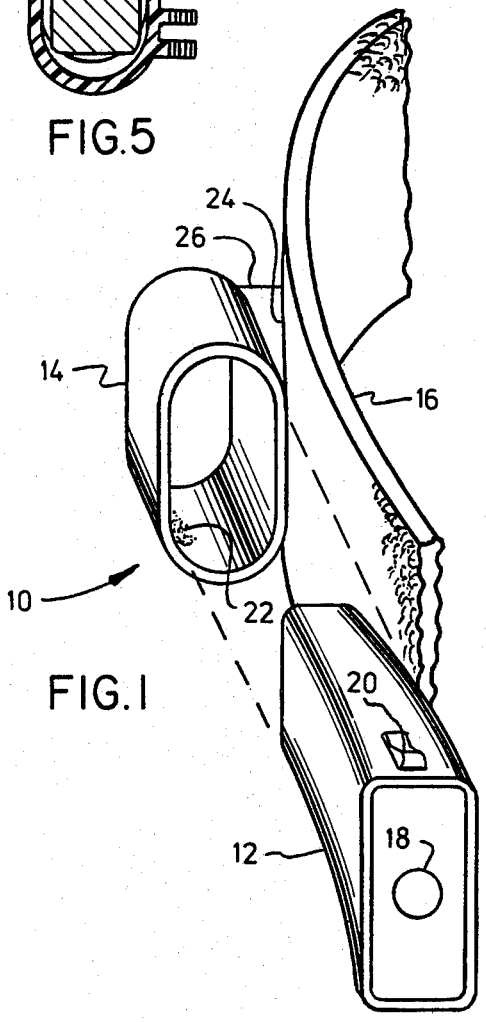
FIG. 1 is a perspective view of a headlamp assembly with a detachable flashlight and a clip attached to an elastic headband according to the present invention.

In reference now to FIG. 1, a headlamp assembly 10 is shown according to the present invention. Headlamp assembly 10 includes a flashlight 12, a clip 14, and a headband 16. Flashlight 12 is a commonly available type with batteries serving as a self-contained power supply and includes a lamp 18 in the front and a switch 20 on the top. Headband 16 is preferably composed of an elastic fabric.

Clip 14 has a hollow portion that acts as a holster into which the flashlight may be inserted and from which the flashlight may be withdrawn. To improve flashlight retention, the inner surface 22 of the hollow portion of the clip is impregnated with grit particles. Clip 14 is adhesively bonded to headband 16 along the outer surface 24 of a wedge 26 formed in the clip. If, for example, the clip were fabricated from a plastic such as ABS, it could be solvent bonded onto the headband. Wedge 26 acts as angle means to angle the light beam from the flashlight toward the line of sight of the user. This will be discussed below in detail in conjunction with FIGS. 6 and 7.

Figure 2:
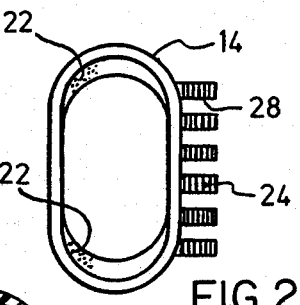
FIG. 2 is an end view of the clip of FIG. 1 and is shown detached from the elastic headband.
Figure 3:
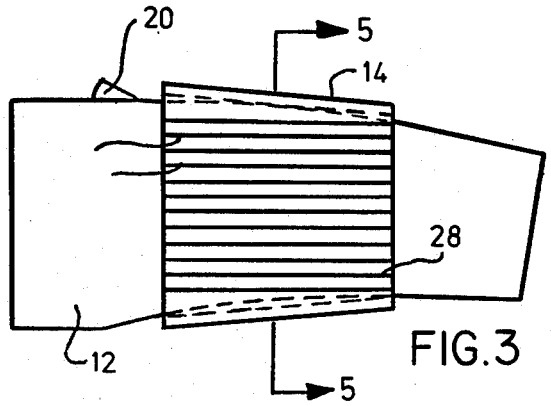
FIG. 3 is a side view of the clip of FIG. 1 and is shown detached from the elastic headband and with the flashlight inserted.
Figure 5:
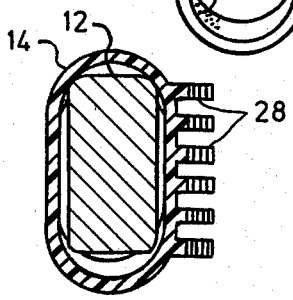
FIG. 5 is a section view of the clip of FIG. 1 and is taken along the section line indicated in FIG. 3.
Figure 4:
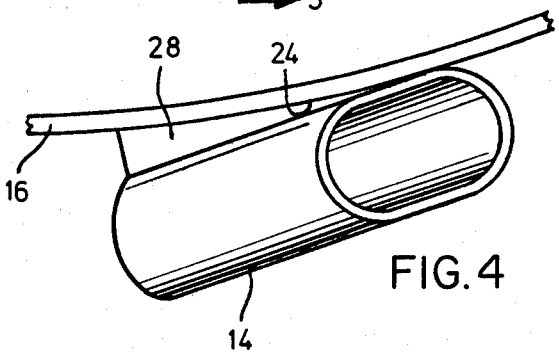
FIG. 4 is a bottom view of the clip of FIG. 1 and is shown attached to the elastic headband.

Turning now to FIGS. 2, 3, and 4, clip 14 is shown in greater detail. Wedge 26 is formed by six ribs 28 that project from the side of the clip. The ribs act to stiffen the clip and act as a surface for adhesively bonding the clip to the headband. As can be seen in particular in FIG. 3, both flashlight 12 and clip 14 have tapered sides that converge toward the rear of the headlamp assembly. In operation, flashlight 12 may be inserted into clip 14 by moving the flashlight in a rearward direction. As a result, the corners of the flashlight contact the radiused inner surface 22 of the clip, thereby locking the flashlight in place (see Fig. 5). Removal of the flashlight is accomplished by moving it forward. In this fashion, clip 14 provides a detachable coupling or mounting for the flashlight.

Figure 6:
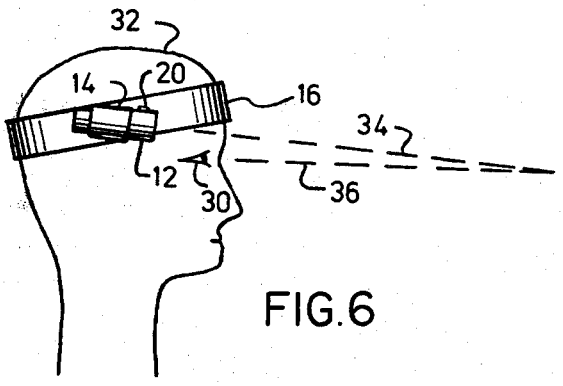
FIG. 6 is a diagrammatic view from the side of a user wearing the headlamp assembly of FIG. 1.
Figure 7:
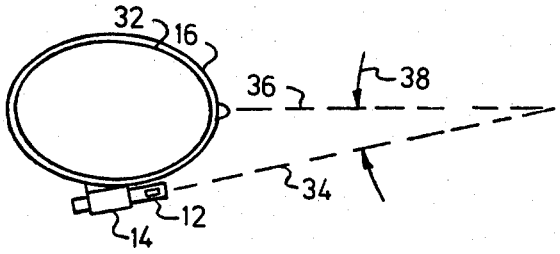
FIG. 7 is a diagrammatic view from the top of a user wearing the headlamp assembly of FIG. 1.

FIGS. 6 and 7 demonstrate the positioning of the headlamp behind the eye 30 of a user 32 to prevent glare. The path of the light beam 34 from the flashlight 12 intersects the user's line of sight 36 out in front of the user. The resulting angle of intersection 38 and the corresponding distance between the user and the intersection point may be varied according to necessity by repositioning headband 16 on the user's head.

What is claimed is:

1. A headlamp assembly including a flashlight with a self-contained power supply, a headband formed to encircle the head of a user, and sleeve means having a longitudinal axis mounted to said headband for positioning said flashlight at a location proximate a side of the user's head, said sleeve means being formed for and detachably mounting said flashlight to said sleeve means, wherein the improvement in said headlight assembly comprises:

said sleeve means being mounted to said headband with the longitudinal axis of said sleeve means oriented at an angle downwardly displaced from the plane of said headband, said sleeve means being formed with wedge means on a side of said sleeve means secured to said headband, said wedge means tapering outwardly from said headband in a rearward direction along said headband to position the front end of said flashlight proximate said band and the rear end of said flashlight outwardly of said headband and said front end to orient the light beam of said flashlight at an angle inwardly toward said headband to cause said light beam to intersect the line of sight of said user at about arm's length from said user when said headlamp assembly is worn on the head of the user and said sleeve means is positioned at a location along the side of the head and rearwardly of the user's eyes to prevent glare in the user's eyes, said flashlight being formed with rearwardly converging side walls, and said sleeve means being formed as a hollow rearwardly tapered sleeve dimensioned for mating receipt of said flashlight therein and frictional engagement with said side walls to effect retention and detachable mounting of said flashlight in said sleeve.

* * * * *